United States Patent [19]

Fife

[11] Patent Number: 4,964,906

[45] Date of Patent: Oct. 23, 1990

[54] METHOD FOR CONTROLLING THE OXYGEN CONTENT OF TANTALUM MATERIAL

[76] Inventor: James A. Fife, Box 151, R.D. 2, Douglassville, Pa. 19518

[21] Appl. No.: 412,426

[22] Filed: Sep. 26, 1989

[51] Int. Cl.[5] ..... C22C 3/00; C21D 1/00

[52] U.S. Cl. ..... 75/369; 148/20.3; 148/126.1

[58] Field of Search ..... 75/0.5 BB; 148/20.3, 148/126.1

[56] References Cited

U.S. PATENT DOCUMENTS 4,722,756 2/1988 Hard ..... 75/0.5 BB

*Primary Examiner*—Melvyn J. Andrews

*Assistant Examiner*—David W. Schumaker

[57] ABSTRACT

A process for controlling the oxygen content in tantalum material comprising heating the material under a hydrogen-containing atmosphere in the presence of a tantalum getter metal having an initial oxygen content lower than the tantalum material.

8 Claims, No Drawings

METHOD FOR CONTROLLING THE OXYGEN CONTENT OF TANTALUM MATERIAL

FIELD OF THE INVENTION

The present invention relates generally to the control of the oxygen content in tantalum materials and particularly to the control, under a hydrogen-containing atmosphere, of oxygen in tantalum. Such materials are especially suitable for capacitor production.

BACKGROUND OF THE INVENTION

Capacitors typically are manufactured by compressing powders, e.g. tantalum, to form a pellet, sintering the pellet in a furnace to form a porous body, and then subjecting the body to anodization in a suitable electrolyte to form a continuous dielectric oxide film on the sintered body.

Development of tantalum powders suitable for capacitors has resulted from efforts by both capacitor producers and powder processors to delineate the characteristics required of tantalum powder in order for it to best serve in the production of quality capacitors. Such characteristics include surface area, purity, shrinkage, green strength, and flowability.

For tantalum capacitors, the oxygen concentration in the tantalum pellets is critical. For example, when the total oxygen content of porous tantalum pellets is above 3000 ppm (parts per million), capacitors made from such pellets may have unsatisfactory life characteristics. Unfortunately, the tantalum powders used to produce these pellets have a great affinity for oxygen, and thus the processing steps which involve heating and subsequent exposure to air inevitably result in an increased concentration of oxygen. In the production of capacitor grade tantalum powder, electronic grade tantalum powder is normally heated under vacuum to cause agglomeration of the powder while avoiding oxidation of the tantalum. Following this heat treatment, however, the tantalum powder usually picks up a considerable amount of additional oxygen because the initial surface layer of oxide goes into solution in the metal during the heating and a new surface layer forms upon subsequent exposure to air thereby adding to the total oxygen content of the powder. During the later processing of these powders into anodes for capacitors, the dissolved oxygen may recrystallize as a surface oxide and contribute to voltage breakdown or high leakage current of the capacitor by shorting through the dielectric layer of amorphous oxide. Accordingly, the electrical properties of tantalum capacitors would be markedly improved if the oxygen content could be controlled, i.e., decreased, maintained about constant or increased within acceptable limits.

One technique which has been employed to deoxidize tantalum powder has been through the mixing of alkaline earth metals, aluminum, yttrium, carbon, and tantalum carbide with the tantalum powder. However, there are certain disadvantages to this technique. The alkaline earth metals, aluminum, and yttrium form refractory oxides which must be removed, e.g., by acid leaching, before the material is suitable for capacitors. With respect to carbon, the amount of carbon must be carefully controlled since residual carbon is also deleterious to capacitors even at levels as low as 50 ppm. Still, other methods which have been proposed involve using a thiocyanate treatment or using a hydrocarbon or reducing atmosphere during some of the tantalum processing stages in order to prevent oxidation and thus keep the oxygen content low.

Another process scheme proposed in U.S. Pat. No. 4,722,756 (Hard) for the control of the oxygen content of tantalum and columbium materials provides for heating the material in an atmosphere containing hydrogen gas in the presence of a metal more oxygen active than tantalum or columbium, e.g. titanium or zirconium. However, a disadvantage of the Hard process is that the metals utilized in controlling the oxygen content may contaminate the tantalum or columbium material.

OBJECTS AND SUMMARY OF THE INVENTION

It is an object of the present invention to provide a method for controlling the oxygen content in tantalum materials.

It is a further object of this invention to provide a method for controlling the oxygen content in tantalum materials without contaminating the tantalum materials.

The present invention provides a method for controlling the oxygen content in tantalum material by heating the material to a temperature of about 900° C. to about 2400° C. under a hydrogen-containing atmosphere in the presence of a tantalum getter metal having an oxygen concentration lower than that of the tantalum material. The transfer of oxygen from the tantalum material to the tantalum getter metal continues until the oxygen concentration in the tantalum getter metal is about equal to the oxygen concentration in the tantalum material. As a result of using tantalum as the getter metal to control the oxygen content, there is no contamination of the tantalum material.

According to a preferred embodiment of the invention, the tantalum getter metal should be located as close as possible to the tantalum material. In one embodiment, the tantalum getter metal may be mixed with the tantalum material and employed in any physical form which facilitates easy separation from the tantalum material. In another embodiment of the invention, the tantalum getter metal may be employed in the same physical form as the tantalum material thereby obviating the need for separation. In either embodiment, the weight ratio of tantalum getter metal to tantalum material is preferably chosen such that the oxygen content of the tantalum material is controlled within a desired level.

DETAILED DESCRIPTION OF THE INVENTION

The present invention is directed to a method for controlling the oxygen content, i.e., decreasing or maintaining the oxygen content about constant, or minimizing the amount of oxygen pick-up, of tantalum material when subjected to a thermal cycle, e.g., heat treatment of tantalum powder, sintering of tantalum capacitor pellets, annealing of wire and foil and the like. According to the method of the present invention, the tantalum material is heated to temperatures ranging from about 900° C. to about 2400° C., preferably from about 1100° C. to about 2000° C. under a hydrogen containing atmosphere in the presence of a tantalum getter metal having an oxygen concentration lower than the oxygen concentration of the tantalum material. The tantalum getter metal need not be in physical contact with the tantalum material. However, in order to reduce the time required for transferring oxygen from the tantalum material to the getter metal, it is preferable that the tantalum material be located as close as possible to the getter metal. Moreover, the getter metal may be mixed throughout the tantalum material.

According to a preferred embodiment of the present invention, the tantalum getter metal is employed in a physical form which facilitates easy separation from the tantalum material thereby allowing the tantalum getter metal to be mixed with the tantalum material during the process. For example, when the tantalum material is in the form of a powder, the tantalum getter metal is preferably in the form of objects which are substantially larger than the largest agglomerate in the tantalum powder. Examples of such objects include: 10/30 mesh chips from tantalum ingot, tantalum wire, foil, mesh, and the like. These physical forms and/or size differences facilitate separation of the getter metal from the tantalum powder. The process temperature and the amount of tantalum getter metal added to the tantalum material are chosen such that the desired level of oxygen control is achieved during the thermal cycle. For instance, it is shown in Example 1 that getter metal/tantalum powder weight ratios from about 0.33 to 1.0 have provided acceptable effects in a temperature range of 1400° C. to 1460° C.

The use of tantalum as the getter metal overcomes the problem of foreign metal or elemental contamination of the tantalum material thereby preserving the usefulness of the tantalum material for capacitor production.

CAPACITOR PREPARATION AND TESTING

In order to evaluate tantalum powder treated according to the present invention, capacitors were fabricated from the tantalum powder and their properties measured, e.g. microfarad volt per gram (FV/g) and direct current leakage (DCL). In so doing the following procedures were followed:

A. Pellet Fabrication

The tantalum powder was compressed in a commercial pellet press without the aid of binders. The pressed density was 6.25 g/cc using a powder weight of 0.6 g to produce a pellet having a diameter of 0.5 cm. and a length of 0.51 cm.

B. Vacuum Sintering

The compacted pellets were sintered in a vacuum of less than $10^{-5}$ torr (0.00133 Pa) for 30 minutes at a temperature of 1585° C.

C. Anodization

The sintered pellets were placed in a forming bath of 0.1% phosphoric acid at 90°±2° C. The pellets were anodized by increasing the voltage at 1 volt per minute until 100 volts (VDC) were reached at which voltage the pellets were held for 3 hours. The pellets were then washed and dried.

D. Measurement Of Direct Current Leakage (DCL)

The anodized pellets are placed into a 10% phosphoric acid solution, thereby producing a capacitor. The pellets were immersed in the 10% phosphoric acid solution to the top of the pellets. The DCL was measured at 70 volts.

E. Determination Of Microfarad Volts/Gram ( FV/g)

After measuring the DCL of the above capacitor, a measurement is made to determine the capacitance of the capacitor at a frequency of 120 Hz. Utilizing conventional testing equipment, the capacitance is measured and reported as microfarads. Thereafter, knowing the weight of the anode and the anodization voltage, one can simply calculate the value of the microfarad volts/gram of the capacitor.

F. Determination of Oxygen Content

The measurement of the oxygen content of the tantalum powder is carried out utilizing an inert gas fusion technique. In this instance, a Leco TC-30 oxygen and nitrogen analyzer was employed.

The following examples are provided to further illustrate the invention. The examples are intended to be illustrative in nature and are not to be construed as limiting of the scope of the invention.

EXAMPLE 1

A series of experiments were conducted to study the effect of utilizing a tantalum getter metal to control the oxygen content of tantalum powder. Eleven tantalum powder samples (1362 g each) Were chosen from the same feedstock having an oxygen content of 1535 ppm and doped with 50 ppm phosphorus.

Ten of the samples were physically mixed with −10/+30 mesh size tantalum getter chips having an oxygen content of 35 ppm. The ten mixed samples were heat treated under a hydrogen atmosphere at varying temperatures, and for varying periods of time and at varying getter/powder weight ratios as shown in Table I. The hydrogen pressure utilized in preparing all ten samples was 2 torr.

In more detail, the samples of tantalum powder mixed with getter metal were heated in a furnace under vacuum to 1050° C. and held for approximately 30 minutes until the powder outgassing was completed and the furnace pressure had decreased to less than one micron.

After the outgassing was completed, the furnace was backfilled with hydrogen to a pressure of 2 torr. The furnace temperature was then increased to the heat treatment temperature shown in Table I and the resulting temperature was held for the duration shown in Table I. Thereafter, the hydrogen was evacuated from the furnace and the furnace cooled. When the furnace cooled to room temperature, the tantalum powder was removed from the furnace and jaw crushed to −50 mesh size. The −10/+30 mesh size tantalum getter chips which are not affected by the jaw crushing, were separated from the tantalum powder by screening.

The eleventh sample was utilized as a control. The sample was heat treated in the same manner as the ten other mixed samples except for the following: the heat treatment was carried out under vacuum of less than 1 millitorr; no tantalum getter metal was mixed with the tantalum powder; and no hydrogen was introduced into the furnace. In this instance, the sample was heat treated at 1525° C. for 30 minutes under vacuum. After cooling, the sample was jaw crushed to −40 mesh size.

The results of all eleven experiments are shown in Table I below. In considering the data it should be kept in mind that the initial oxygen content of the tantalum sample being treated was 1535 ppm oxygen, and the initial oxygen content of the tantalum getter metal was 35 ppm oxygen.

TABLE I

| Experiment Number | Getter/Sample Weight Ratio | Heat Treat. Temperature (°C.) | Heat Treat. Duration (minutes) | Final Oxygen (ppm) | Oxygen Pickup (ppm) |
|---|---|---|---|---|---|
| 1 | 1.00 | 1400 | 60 | 1785 | 250 |
| 2 | 0.33 | 1400 | 60 | 2025 | 490 |
| 3 | 1.00 | 1460 | 60 | 1665 | 130 |
| 4 | 0.33 | 1460 | 60 | 1975 | 440 |
| 5 | 1.00 | 1400 | 90 | 1760 | 225 |
| 6 | 0.33 | 1400 | 90 | 2085 | 550 |
| 7 | 1.00 | 1460 | 90 | 1680 | 145 |
| 8 | 0.33 | 1460 | 90 | 2030 | 495 |
| 9 | 1.00 | 1430 | 75 | 1695 | 160 |
| 10 | 0.33 | 1430 | 75 | 2000 | 465 |
| 11 (CONTROL) | 0.00 | 1525 | 30 | 2110 | 575 |

As will be shown in Example 2 below, the control sample (11) has certain electrical values, e.g., microfarad volts/gm and 100 volt DC leakage, which the other experimental samples were intended to achieve. While so doing, as will be shown in Example 2, all ten samples prepared by the process of the present invention have electrical properties about equivalent to the control sample while having a markedly lower level of oxygen pick-up. Specifically, the initial oxygen content level of the tantalum feedstock was 1535 ppm oxygen; subsequent heat treatment showed the levels of oxygen content increasing by amounts of 130 to 575 ppm, with the greatest oxygen increase attributable to the control sample, i.e. the sample without getter metal. In other words, the data in Tables I and II clearly reflect that the oxygen content of tantalum powder can be controlled when utilizing tantalum getter metal according to the present invention, while maintaining the electrical properties of capacitors made from the powder.

EXAMPLE 2

The following Table II illustrates that the electrical properties of anodes are not adversely affected by using tantalum getter metal to control the oxygen content of the tantalum powder used to produce anodes. The samples heat treated in Example 1 were pressed to form pellets (0.6 g) having a density of 6.25 g/cc. The pellets were then sintered at 1585° C. for 30 minutes and then anodized to 100 volts in 0.1% phosphoric acid solution.

TABLE II

| Exp. No. | Getter/Sample Weight Ratio | Heat Treat Temp (C.) | Heat Treat Time (Min) | FV/g | DCL |
|---|---|---|---|---|---|
| 1 | 1.00 | 1400 | 60 | 11140 | 0.10 |
| 2 | 0.33 | 1400 | 60 | 11350 | 1.09 |
| 3 | 1.00 | 1460 | 60 | 10950 | 0.10 |
| 4 | 0.33 | 1460 | 60 | 11210 | 0.10 |
| 5 | 1.00 | 1400 | 90 | 11110 | 0.10 |
| 6 | 0.33 | 1400 | 90 | 11400 | 0.09 |
| 7 | 1.00 | 1460 | 90 | 11140 | 0.12 |
| 8 | 0.33 | 1460 | 90 | 10910 | 0.10 |
| 9 | 1.00 | 1430 | 75 | 11320 | 0.10 |
| 10 | 0.33 | 1430 | 75 | 10950 | 0.10 |
| 11 | 0.00 | 1525 | 30 | 11310 | 0.09 |

EXAMPLE 3

A series of experiments were conducted to study the effect of utilizing a tantalum getter metal to control the oxygen content of a tantalum powder feedstock having an initial oxygen content substantially higher than that of the tantalum feedstock of Examples 1 and 2. Nine tantalum powder samples (approximately 200 g each) were chosen from the same feedstock having an oxygen content of 5940ppm. Eight of the samples were mixed with −10/+30 mesh size tantalum getter chips having an oxygen content of 35ppm. The eight samples were heat treated under a hydrogen atmosphere at various temperatures, at various pressures and at various getter/powder weight ratios as shown in Table III. Sample 9, which was used as a control sample, was heat treated in the same manner as the other eight samples except that no hydrogen was introduced to the furnace and no getter metal was added to the tantalum powder.

The results of all nine experiments are shown in Table III below:

TABLE III

| Experiment Number | Getter/Sample Weight Ratio | Hydrogen Pressure (mmHg) | Heat Treat. Temp. (°C.) | Heat Treat. Duration (minutes) | Oxygen Pickup (ppm) |
|---|---|---|---|---|---|
| 1 | 1.50 | 5.0 | 1400 | 60 | −605 |
| 2 | 0.33 | 5.0 | 1400 | 60 | −310 |
| 3 | 1.50 | 5 0 | 1350 | 30 | −240 |
| 4 | 0.33 | 5.0 | 1350 | 30 | +40 |
| 5 | 1.00 | 4.2 | 1400 | 30 | −255 |
| 6 | 1.00 | 1.0 | 1400 | 30 | +90 |
| 7 | 1.00 | 1.0 | 1400 | 60 | −200 |
| 8 | 1.00 | 1.0 | 1400 | 30 | +85 |
| 9 | 0.00 | 0.0 | 1400 | 30 | +260 |

The data reported in Table III clearly demonstrate that the oxygen content of tantalum powder can be reduced or held about constant when utilizing tantalum getter metal according to the present invention.

As will be apparent to those skilled in the art, the present invention may be embodied in other forms or carried out in other ways without departing from the spirit or essential characteristics of the invention.

What is claimed is:

1. A process for controlling the oxygen content in tantalum material comprising heating said material at a temperature ranging from about 900° C. to about 2400° C. under a hydrogen-containing atmosphere in the presence of a tantalum getter metal having an oxygen concentration prior to said heating lower than that of said tantalum material.

2. The process of claim 1, wherein said tantalum getter metal is out of contact with said tantalum material.

3. The process of claim 1, wherein said tantalum getter metal is mixed with said tantalum material.

4. The process of claim 3, wherein said tantalum getter metal is in a physical form which provides for separation from said tantalum material.

5. The process of claim 4 wherein the tantalum material is a tantalum powder and the tantalum getter metal is an object having a size substantially greater than the largest particle size of said tantalum powder.

6. The process of claim 1 wherein the tantalum material is heated at a temperature ranging from about 1100° C. to about 2000° C.

7. The process of claim 1 wherein the tantalum material is heated at a temperature ranging from about 900° C. to about 1500 C.

8. The process of claim 1 wherein the tantalum getter metal is mixed with the tantalum material in a weight ratio of about 0.3 to about 1.0.

* * * * *